US007047891B2

(12) United States Patent
Vatsky

(10) Patent No.: US 7,047,891 B2
(45) Date of Patent: May 23, 2006

(54) OVERFIRE AIR PORT AND FURNACE SYSTEM

(76) Inventor: Joel Vatsky, 501 Lindabury La., Pottersville, NJ (US) 07979

( * ) Notice: Subject to any disclaimer, the term of this patent is extended or adjusted under 35 U.S.C. 154(b) by 0 days.

(21) Appl. No.: 10/360,189

(22) Filed: Feb. 7, 2003

(65) Prior Publication Data

US 2003/0145768 A1 Aug. 7, 2003

Related U.S. Application Data

(60) Provisional application No. 60/355,674, filed on Feb. 7, 2002.

(51) Int. Cl.
*F23L 13/00* (2006.01)
*F23B 5/00* (2006.01)

(52) U.S. Cl. ..... 110/297; 110/210; 110/214; 110/309; 110/310; 110/313

(58) Field of Classification Search ..... 239/423, 239/424, 590, 590.5; 110/211, 213, 309, 110/310, 314, 318, 210, 214, 265, 297, 308, 110/348; 431/10, 174
See application file for complete search history.

(56) References Cited

U.S. PATENT DOCUMENTS 2,090,740 A * 8/1937 Zimmerman ..... 239/419.3
2,956,527 A * 10/1960 Hopwood ..... 110/313
4,566,393 A * 1/1986 Connell et al. ..... 110/261
4,722,287 A 2/1988 Anderson et al.
5,011,400 A * 4/1991 Vatsky ..... 431/4
5,020,454 A 6/1991 Hellewell et al.
5,347,937 A * 9/1994 Vatsky ..... 110/261
5,408,943 A * 4/1995 Vatsky ..... 110/261
5,727,480 A 3/1998 Garcia-Mallol
5,762,007 A * 6/1998 Vatsky ..... 110/264
5,842,426 A * 12/1998 Ohta et al. ..... 110/261
6,145,450 A * 11/2000 Vatsky ..... 110/265
6,318,277 B1 11/2001 Kokkinos
6,490,985 B1 12/2002 Yamamoto et al.

OTHER PUBLICATIONS

International Search Report, Mailing Date Aug. 7, 2003.

* cited by examiner

*Primary Examiner*—Kenneth Rinehart
(74) *Attorney, Agent, or Firm*—Lerner, David, Littenberg, Krumholz & Mentlik, LLP

(57) ABSTRACT

An Overfire Air (OFA) port design and method for use in a furnace system is disclosed. The OFA port design effectively reduces the amount of harmful pollutants emitted into the atmosphere upon discharge from an associated furnace.

21 Claims, 6 Drawing Sheets

(2 of 6 Drawing Sheet(s) Filed in Color)

OVERFIRE AIR PORT AND FURNACE SYSTEM

CROSS-REFERENCE TO RELATED APPLICATION

This application claims benefit of U.S. Provisional Patent Application 60/355,674, filed Feb. 7, 2002, the disclosure of which is incorporated by reference herein.

BACKGROUND OF THE INVENTION

This invention relates to furnace systems and more particularly to furnace systems, which employ an overfire air (OFA) process to reduce harmful by-products, such as CO, $NO_x$ and unburned carbon products.

The complete combustion of fossil fuels or other types of organic and chemical fuels in a furnace requires a fixed and known quantity of combustion air. The relationship between air and fuel is known as stoichiometric combustion conditions. Because the supply of stoichiometric air to the combustion and subsequent consumption of fuel is theoretical, a furnace of infinite size would be required to achieve complete combustion. In existing furnaces, more air is supplied than is theoretically required. This additional quantity is referred to as excess air.

In the absence of such excess air, significant quantities of by-products are produced due to incomplete combustion. Such by-products include hydrocarbons (HC) and carbon monoxide (CO). Although the use of excess air helps to eliminate undesirable HC and CO by-products, during combustion at the burners the excess $O_2$ combines with nitrogen (N) released from fuel particles to form nitrous oxides ($NO_x$), harmful pollutants that permeate into the atmosphere upon exit from the furnace.

The overfire air (OFA) process was developed in the 1950s to reduce $NO_x$ output. The OFA process is an air staging process that regulates the supply of air necessary to complete the combustion process. Typically, the OFA process occurs in two stages.

The first stage requires removal of a portion of the combustion air from the combustion zone, where the burners are located. Removing a portion of the combustion air allows for the combustion process to begin under fuel-rich conditions. Such conditions result in a significant reduction and prevention of the formation of $NO_x$, but simultaneously cause the formation of high levels of carbon monoxide (CO) and unburned carbon products (UBC).

The second stage of the OFA process remedies this shortcoming. In this stage, the removed air is injected through OFA ports located above the combustion zone, or in the CO burnout zone. The injection of the removed air in the CO burnout zone provides the stoichiometric amount of air necessary for complete combustion to occur. Ultimately, CO oxidizes to form $CO_2$.

Use of the OFA process therefore provides the balance necessary to reduce the formation of harmful $NO_x$ and CO.

Combustion efficiency is affected by various factors including the time that the fuel source is exposed to a flame, the temperature and turbulence (i.e., mixing between the air and fuel particles). Various prior art furnace systems exist, which include OFA ports and other features affecting the amount of time, temperature and mixing necessary for effective combustion. These variables include the number of OFA ports, the location of such ports relative to the combustion zone, the design of the OFA ports (e.g., single stage and dual stage port design) and various mixing methods.

To address the problem of insufficient mixing, "two stage" or "dual throat" OFA port designs have been implemented. Such designs are intended to create a "near zone" flow field that causes rapid mixing between the OFA flow and the furnace gases close to the injection wall. This is generally accomplished by causing the air in the outer throat or stage to swirl. Further, high velocity axial air flow from the inner stage or throat permits the OFA to penetrate sufficiently far into the furnace, thereby achieving greater mixing in the interior of the furnace. Prior art two stage OFA ports are subject to various problems. One of the defects of the swirling outer flow is that rotational flow results in up-flow along one side of the port and down-flow on the other side. Because the mixing is not symmetrical about the vertical centerline of the port, unmixed furnace gases are permitted to pass by the port yielding undesirable amounts of CO and other by-products of incomplete combustion, which flow out of the furnace.

SUMMARY OF THE INVENTION

The present invention overcomes the various shortcomings of prior art furnace systems including OFA ports by providing a novel and unobvious systems and methods relating to OFA port arrangement and design.

In accordance with the present invention, a furnace utilizing a unique configuration of OFA ports is disclosed. The furnace comprises a housing with sidewalls. At least one burner defining a combustion zone is arranged in the housing between the sidewalls. In a preferred embodiment, a plurality of burners may also be used. A plurality of vertical lanes defined by space exists between the sidewalls and opposing sides of the combustion zone. A plurality of OFA ports are arranged in the housing located above the combustion zone. The OFA ports are arranged in a plurality of rows. The row located furthest from the combustion zone (the "upper row") includes a greater number of OFA ports than the number of OFA ports in the row closest to the combustion zone (the "lower row"). The lower row includes at least one OFA port located in a lane between the furnace side walls and one of the outermost ends of the combustion zone of the burners closest to the sidewalls, defines a plurality of vertical lanes. In one embodiment, the lower row may only include two OFA ports—one OFA port being located in a first lane and another OFA port located in a second lane. In other embodiments, the lower row may include more than two OFA ports.

In addition to substantially reducing $NO_x$ output, the design of the furnace of the present invention has also been developed to reduce the amount of CO emitted from the furnace. By removing a portion of the combustion air from the combustion zone and injecting such air through OFA ports arranged in the lanes above the combustion zone and between the outermost ends thereof and the furnace wall, oxygen in the OFA will be injected into the furnace to oxidize CO traveling up the lanes and to thus convert such CO into $CO_2$. Moreover, placement of the OFA ports in the lanes between the burners at the edges of the combustion zone and furnace walls allow for greater mixing of the OFA with CO, which flows upward in the lane to maximize conversion of CO into $CO_2$ before a substantial portion of the CO exits the furnace. Accordingly, the configuration of the OFA ports reduces the amount of CO present in the furnace and subsequently released into the atmosphere.

In another aspect of this invention, a method of efficiently operating a furnace to reduce the emissions of harmful nitrous oxides into the atmosphere is disclosed. A portion of the combustion air is removed from a combustion zone through use of an OFA system that requires reinjecting that portion of the combustion air into OFA ports located above the combustion zone. According to the method of the present invention, the OFA is reinjected through at least two rows of OFA ports located above the combustion zone. Further, the OFA is reinjected through at least one OFA port located in a row closest to the combustion zone that is in a lane defined by the space between the combustion zone and the sidewall of a furnace.

In another aspect of this invention, an OFA port design is provided for use in a furnace. The OFA port comprises an inner barrel and an outer barrel, both having an inlet end and an outlet end. It should be appreciated that the barrels are not limited to a circular diameter, may have various geometric port configurations, such as circular, elliptical, square triangular, etc. The inner barrel defines an inner passageway that extends between the inlet and outlet ends of the inner barrel. The purpose of the inner barrel is to accommodate the flow of air.

The outer barrel extends coaxially with and at least partially surrounds the inner barrel between the inner barrel's inlet and outlet ends, so that an outer passageway is formed between the inner and outer barrel. The passageway also serves to accommodate the flow of air.

Another novel aspect of this invention is the placement of baffles in the outer passageway to aerodynamically achieve greater reduction of UBC and CO than those methods disclosed by the prior art. Air flowing over the baffles creates a low pressure zone on the downstream side of each baffle. As the air flows past the baffles, the low pressure zones cause the air flow to exit the passageway such that the flow from the outer passageway is drawn sideways. This creates a greater recirculation area around the axial OFA flow exiting from the inner barrel. As a result, greater mixing is achieved. Indeed, the baffles eliminate the need for swirl vanes or mixing devices to aid in mixing of the air.

It should be appreciated that at least one baffle should be placed within the outer passageway to achieve the desired result. In a preferred embodiment, two baffles placed on opposing sides of the outer passageway achieve maximum results. Further, the baffles are therefore preferably located closest to the outlet end of the outer barrel.

Another novel aspect of this invention is the change in shape between the inlet and outlet ends of both or either of the inner and outer barrels. The respective ends can comprise any geometric configuration, including without limitation, a circle, ellipse, square, or triangle, but the shape of the inlet end and outlet end preferably differ. In a preferred embodiment the inlet ends of the barrels are circular in shape and the outlet ends are elliptical. It should be noted that the ellipse of the outlet end of the outer barrel comprises a major and minor axis, wherein the major axis is the longest portion of the ellipse and may be located on the horizontal axis. Accordingly, the minor axis comprises the shorter portion of the ellipse, and may be located on the vertical axis.

In yet another aspect of this invention, the ellipse of the outlet end of the inner barrel also comprises a major and minor axis, wherein the shortest portion of the ellipse constitutes the minor axis, and the longer portion of the ellipse constitutes the major axis. In a novel aspect of this invention, the major axis of the inner barrel is preferably located within the minor axis of the outer barrel. Thus, the longer portion of the ellipse of the inner barrel is coaxially placed along the vertical axis of the shorter portion of the outer barrel.

In another embodiment, the inner barrel is comprised of three sections: an inlet section, a transition section, and a geometric section. The inlet section is preferably circular in shape and accepts the flow of OFA air. In the transition section, the geometry of the port configuration changes from circular to preferably elliptical. The transition region is also preferably tapered to decrease the diameter of the inner barrel as it extends between the inlet and outlet ends whereby the velocity at which the OFA travels is increased within the transition region. Finally, the geometric section of the inner barrel retains the geometry of the transition section and also provides an exit for OFA air. Preferably, the elliptical shape of the inner barrel extends throughout the entire length of the OFA port to allow greater axial penetration of the OFA in the furnace.

In the same preferred embodiment, the outer barrel is comprised of two sections, an inlet section and a transition section. The inlet section has a port geometry that is preferably circular and accepts the flow of OFA. The transition section further comprises a transitional inlet and transitional outlet end. In a preferred embodiment, the diameter of the transition section increases in size from the transitional inlet end to the transitional outlet end. The transition section also provides an area where the OFA will exit the port.

In another preferred embodiment, the geometry of the port configuration of the transition section changes from circular to preferably elliptical.

Preferably, the flow from the inner passageway is axial to promote deep penetration in the furnace chamber, in contrast to the outer passageway flow that is designed to mix in the transverse direction to the inner flow.

Another aspect of this invention relates to an entire furnace which comprises a combustion chamber and an OFA port as part of an overall OFA system which provides for reduced UBC and CO. The OFA port in accordance with this aspect of the invention may include all or some of the features discussed above.

In a preferred embodiment of the present invention, a sleeve damper may be provided which at least partially surrounds the outer barrel between the inlet and outlet ends. In a particularly preferred embodiment, the sleeve damper is located at the inlet end of the outer barrel. The sleeve damper is particularly effective in regulating the amount of OFA flow into the OFA port.

In another embodiment of the present invention, the OFA port will comprise a cone or a center body located at the inlet end of the inner barrel. The cone will effectively transform radial airflow to a non-turbulent coherent axial flow. It also minimizes any increase in pressure.

In yet another embodiment of the present invention, a distribution plate may be provided, which at least partially surrounds the outer barrel between the inlet and outlet ends of the outer barrel. The distribution plate distributes air evenly around the circumference of the register.

Another embodiment of the present invention further contemplates the use of geometry to aerodynamically reduce the degree of turbulence in the OFA port, as well as, to reduce the amount of pressure drop. Specifically, a chamfered corner is formed at the junction where the distribution plate and the outer barrel meet.

In yet another aspect of the present invention, a furnace system is contemplated comprising a housing, a combustion zone, a configuration of OFA ports according to the present invention, and an OFA port design according to the present invention.

Accordingly, it is an object of the present invention to produce a configuration of OFA ports which will reduce the amount of UBC and CO that results from combustion.

It is another object of the present invention to provide an OFA port design which can be inexpensively manufactured.

It is another object of the present invention to aerodynamically reduce the amount of UBC and CO, by varying the shape of the inlet end and outlet end of both inner and outer barrels and eliminating the need for adjustable swirl vanes or mixing devices.

It is still another object of the present invention to provide an OFA port which overcomes the problems of unsymmetrical mixing about the OFA port vertical centerline, which in turn permits unmixed furnace gases, which yield non-minimum amounts of CO and other products of incomplete combustion, to flow unchanged to the furnace exit.

The above objects, features and advantages of the present invention will be more fully appreciated when considered in conjunction with the following details description of he preferred embodiments and accompanying drawings.

BRIEF DESCRIPTION OF THE DRAWINGS

The patent or application file contains at least one (1) drawing executed in color. Copies of this patent or patent application publication with color drawing (s) will be provided by the Office upon request and payment of the necessary fee.

DETAILED DESCRIPTION

Figure 1:
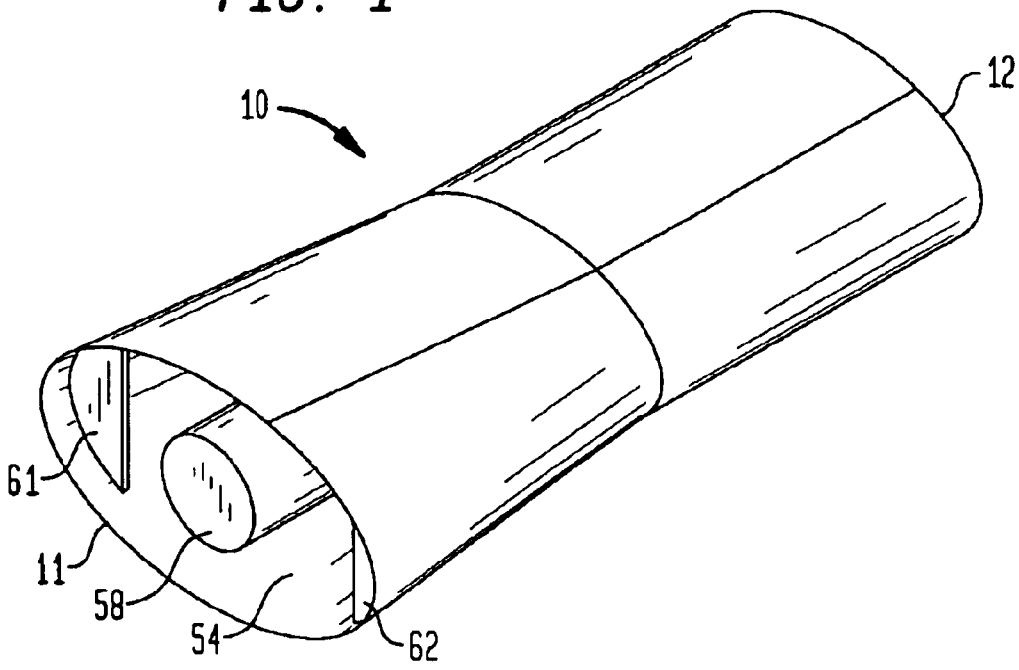
FIG. 1 is a perspective view of the overfire air (OFA) port of the present invention.
Figure 2:
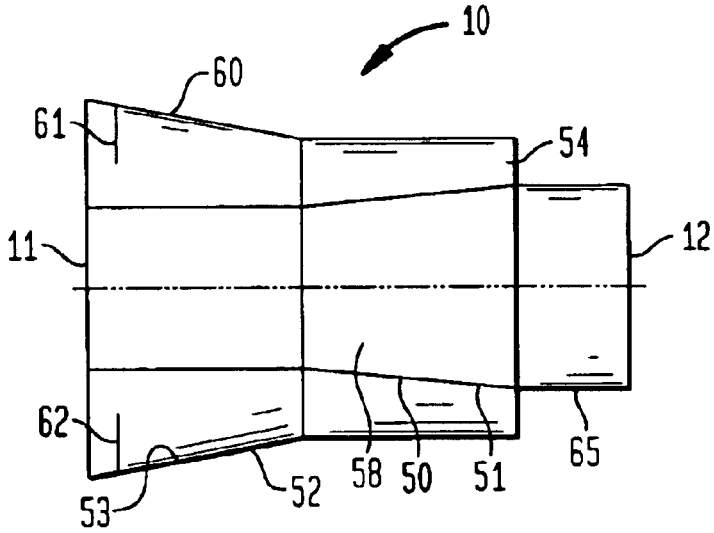
FIG. 2 is a schematic cross-sectional side view of the present OFA port.

As shown in FIGS. 1 and 2 an overfire air (OFA) port 10 of the present invention includes an outlet end 11 and an inlet end 12. In the preferred embodiment of FIG. 1, the OFA port 10 is generally tapered from a relatively large elliptical diameter at the outlet end 11 to a relatively circular diameter at the inlet end 12. The materials of which the OFA port may be made are conventional and may include various materials capable of withstanding extreme heat, such as iron, steel, ceramic or the like.

As shown in FIG. 2, the OFA port 10 includes an elongated inner barrel 50 defining an inner passageway 58 and an elongated outer barrel 52 that surrounds inner barrel 50 and extends substantially coaxially therewith.

An outer passageway 54 is formed between the inner barrel 50 and the outer barrel 52. Both the inner passageway 58 and outer passageway 54 are generally annular and are used as flow paths for reinjecting OFA into and associated the furnace.

Figure 3:
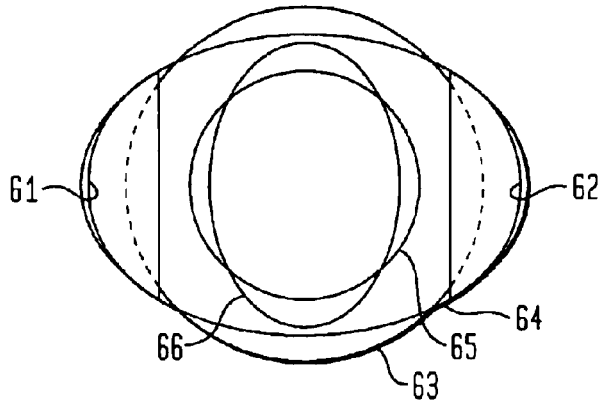
FIG. 3 is a schematic front view of the present OFA port.

As shown in FIGS. 2 and 3, a transition region 60 of the outer barrel 52 is arranged between the inlet end 12 and the outlet end 11 of the OFA port 10. The transition region 60 is tapered to increase in diameter along the direction of air flow. In the embodiment of FIGS. 1, 2 and 3, region 60 transitions from a circular configuration at outer circular duct 63 to an elliptical configuration at elliptical duct 64.

Baffles 61, 62 are arranged near the outlet end 11 of the outer passageway 54 to facilitate uniform mixing of the OFA. It should be noted that only one baffle may be used or more than two baffles. Furthermore, various shapes and sizes of baffles may be utilized according to the present invention. The use of baffles is an improvement over prior art designs as it accomplishes efficient mixing in the furnace.

The inner barrel 50 also contains a transition region 51 that transitions from circular duct 65 to elliptical duct 66. As shown in FIG. 3, the elliptical duct 66 is arranged vertically within the horizontal elliptical duct 64 of the outer ellipse.

As illustrated in FIGS. 1, 2 and 3, the diameter of outer barrel 52 increases from a relatively small diameter at inlet end 12 to a relatively large diameter at outlet end 11. The degree of the taper in a preferred embodiment is between one degree and fifteen degrees. However, alternative embodiments of the present invention may not include any taper at all or may include tapers greater than fifteen degrees.

The particular size and configuration of the outer circular duct 63 at the inlet end 12 of the OFA port 10, as well as, the radius of the outer circular duct 63 may vary in alternative embodiments of the present invention. In one preferred embodiment the diameter of the inner circular duct 65 of the inner barrel 50 may be about seventeen inches, while the diameter of the outer circular duct 63 of the outer barrel 52 may be about twenty-six inches.

The particular size and configuration of the horizontal elliptical duct 64 of the outer barrel 52, as well as, the inner elliptical duct 66 of the inner barrel 50 may also vary in alternate embodiments of the present invention. In one embodiment, the horizontal elliptical duct 64 may have a length of about thirty-three and one-half inches on its major axis; and twenty-two and one-third inches on the minor axis. The length of the inner elliptical duct 66 of inner barrel 50 on its major axis may be twenty-one inches; and fourteen inches on its minor axis.

The particular size, shape and location of the baffles 61, 62 will also vary in alternative embodiments of the present invention. In a preferred embodiment, the baffles 61, 62 will be attached to the inner wall 53 of the outer barrel 52. The baffles may be located several inches from the outlet end 11 of outer barrel 51. The outermost edges of the baffles 61, 62 closest to the inner wall 53 of the outer barrel 52 may take on the shape of the outer barrel 52. Thus, in a preferred embodiment, where the outer barrel 52 is an ellipse, the outermost edges of the baffles 61, 62 will be elliptical. It should be appreciated that the baffles may be attached to the OFA port in various ways and are not limited to being attached to the outer barrel. In an alternative embodiment, the baffles may be attached to the inner barrel.

As shown in FIGS. 3, 4, 8 and 9 the OFA port 10 is a single component of an entire OFA system.

Figure 4:
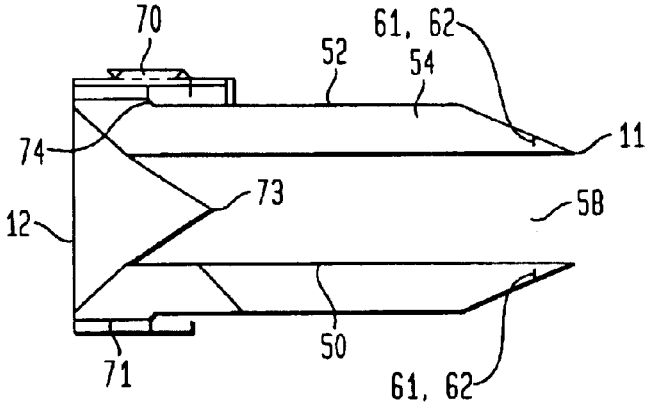
FIG. 4 is a schematic side view of the present OFA port.
Figure 5:
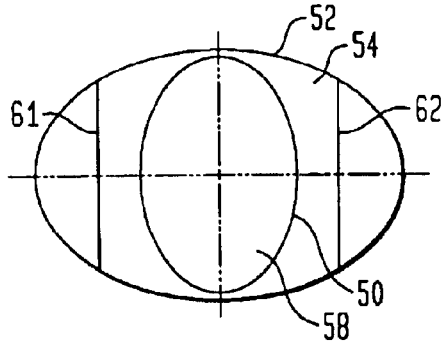
FIG. 5 is a simplified schematic front view of the present OFA port.

As shown in FIG. 4, a sleeve damper 70 is located between the inlet end 12 and the outlet end 11 of the outer barrel 52. The sleeve damper 70 translates to vary the size of the opening to the outer passageway 54. In this regard, it is effective for controlling the total airflow through the OFA ports. An actuator can be used to remotely control the damper. A cone 73 is arranged in the center body of the register to transform the airflow from radial (as it is when entering the conical region) to axial flow. The cone 73 also functions to minimize the pressure drop of air in the OFA port.

A distribution plate 71 at least partially surrounds, and is connected to, the outer barrel 52 within the vicinity of the sleeve damper 70. In a preferred embodiment, the distribution plate 71 entirely surrounds a portion of the outer barrel 54. It may be connected to the outer barrel 54 by welding, or various other means of attachment (e.g., clamps, rivets, screws, adhesive, etc.). The distribution plate 71 distributes air evenly around the circumference of the register. In a preferred embodiment, the distribution plate 71 is constructed of perforated stainless steel.

A chamfered corner 74 adjacent to the distribution plate 71 reduces turbulence and pressure drop through the turn.

Figure 6:
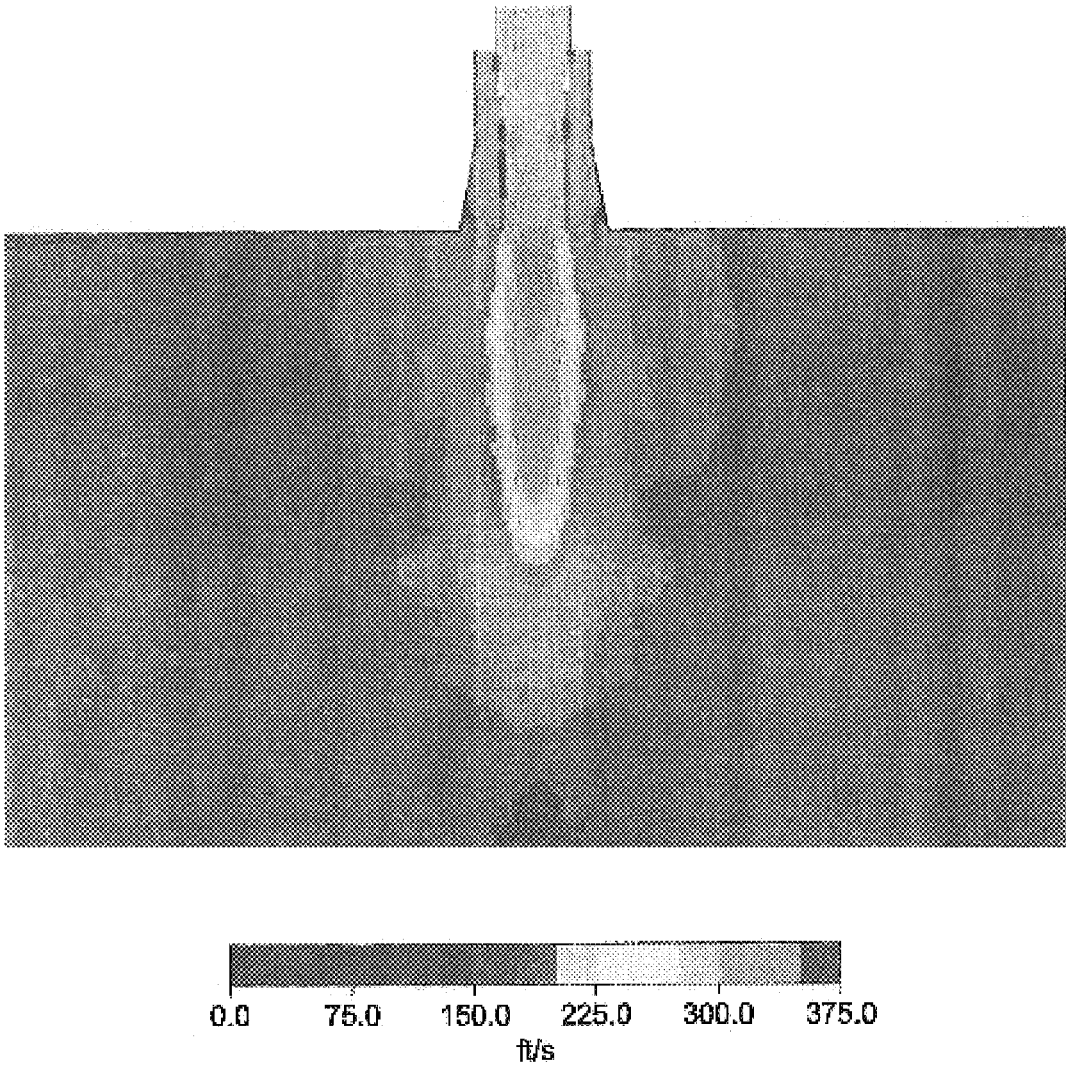
FIG. 6 is a computer simulated air flow illustrating use of the present OFA port.
Figure 7:
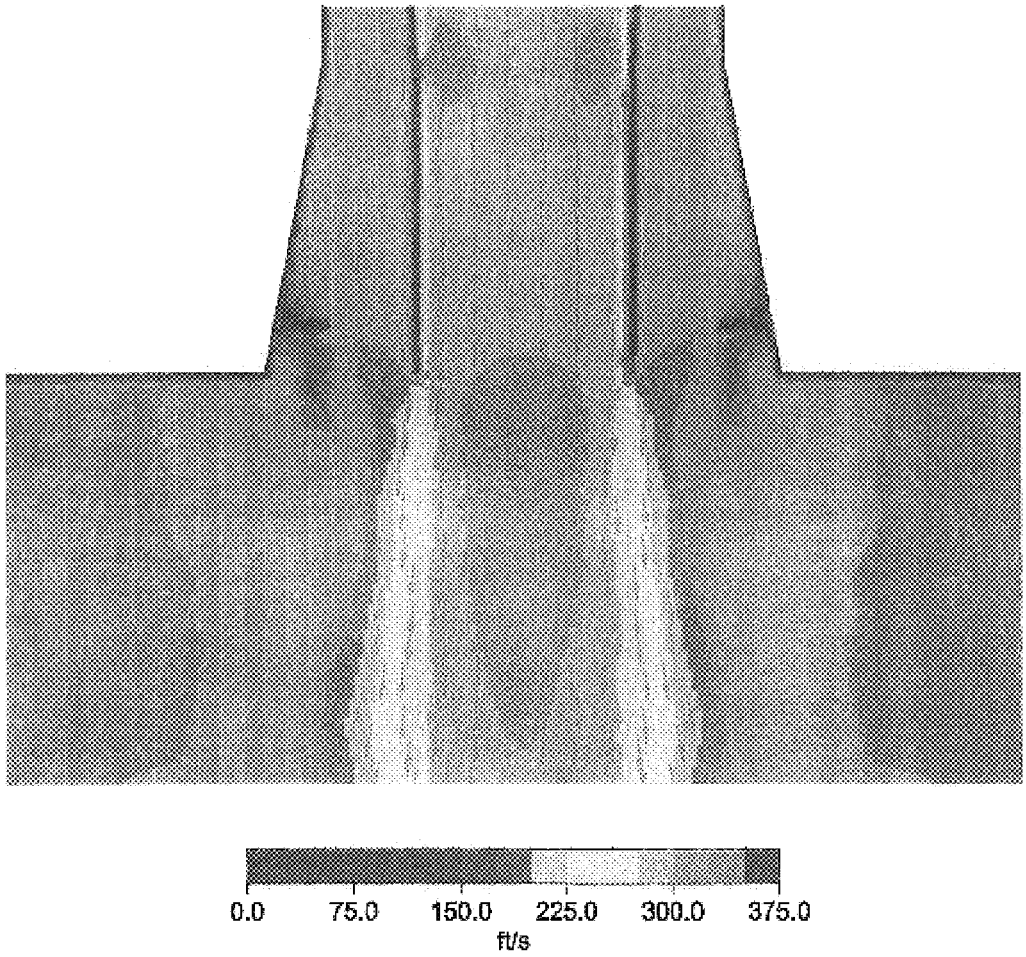
FIG. 7 is another computer simulated air flow illustrating use of the present OFA port.

The results of computer simulations using the OFA port 10 with different airflow velocities exemplify the advantages of using the present OFA port assembly. FIG. 6 displays the air flow results of a computer simulated model where the inner passageway airflow is at 60% of the total airflow. FIG. 7 is an amplified detail of the near-throat zone of FIG. 6. The airflow from the passageway 58 inner barrel 50 penetrates axially into the furnace. In contrast, the air flow in the passageway 54 outer barrel 52 is interrupted at the baffles 61, 62. This causes the air to disperse laterally into the furnace and to create a greater mixing area.

It can be seen that, as the airflow is increased in the inner passageway 58, the axial penetration is enhanced and the near-zone recirculation is also enhanced. Reducing the inner passageway airflow, results in reduced penetration depth but broader mixing away from the wall.

Thus, according to the present invention, by varying the ratio of inner to outer airflow, the penetration and coverage of the overfire air flow can be optimized to maximize the burnout of CO and other partial products of combustion that are a normal result of the $NO_x$ reduction process using an OFA process. Further, the present OFA port design promotes symmetrical mixing of air about the vertical axis of the OFA port so that there are no unmixed passageways to the furnace exit.

Figure 8:
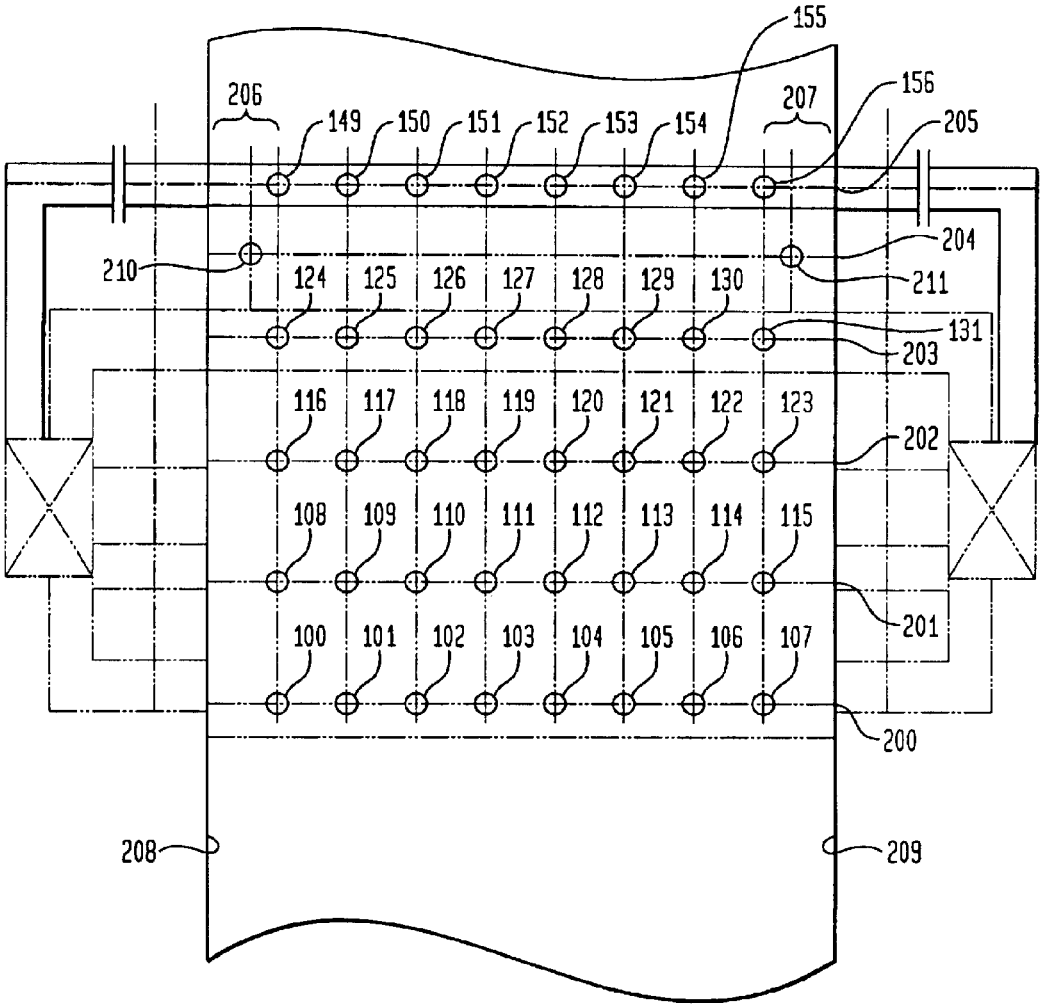
FIG. 8 is a schematic illustration of the OFA port arrangement in the present furnace system.

FIG. 8 illustrates a first elevation of a preferred arrangement of OFA ports within a furnace according to the present invention. The furnace includes a combustion zone defined by a plurality of burners 100–131. The burners 100–131 are arranged in four horizontal rows. In particular, burners 100–107 are arranged in row 200, burners 108–115 are arranged in row 201, burners 116–123 are arranged in row 202 and burners 124–131 are arranged in row 203.

Two rows 204 and 205 of OFA ports are arranged vertically above the combustion cylinder. The lower row 204 includes a pair of OFA ports 210 and 211 arranged in opposing vertical lanes 206 and 207 within the furnace. In particular, the furnace includes a boiler having spaced walls 208 and 209. Vertical lane 206 is defined as the space between boiler wall 208 and vertically arranged burners 100, 108, 116 and 124. Similarly vertical lane 207 is defined as the space between boiler wall 209 and vertically arranged burners 107, 115, 123 and 131. Vertical lanes 206 and 207 extend along the boiler side walls and continue above the combustion zone.

OFA ports 210 and 211 are termed "wing ports" due to their arrangement in the vertical lanes 206 and 207. These OFA ports are arranged outside of the outermost OFA ports in top row 205. Top row 205 includes eight OFA ports 149–156 arranged at a greater vertical distance from the combustion zone than the wing ports 210 and 211 of lower row 204.

While the lower row 204 of OFA ports are shown in FIG. 8 as including only wing ports 210 and 211, it should be appreciated that in alternate embodiments additional OFA ports may be arranged in this row. Further, additional rows of OFA ports may be arranged in a furnace contemplated within the scope of the present invention. However, such an arrangement may increase the cost of the system.

While there may be any number of OFA ports in row 204, it is preferable for the quantity of OFA ports in row 204 (the row closest to the burners) to be less than the quantity of OFA ports in row 205.

Figure 9:
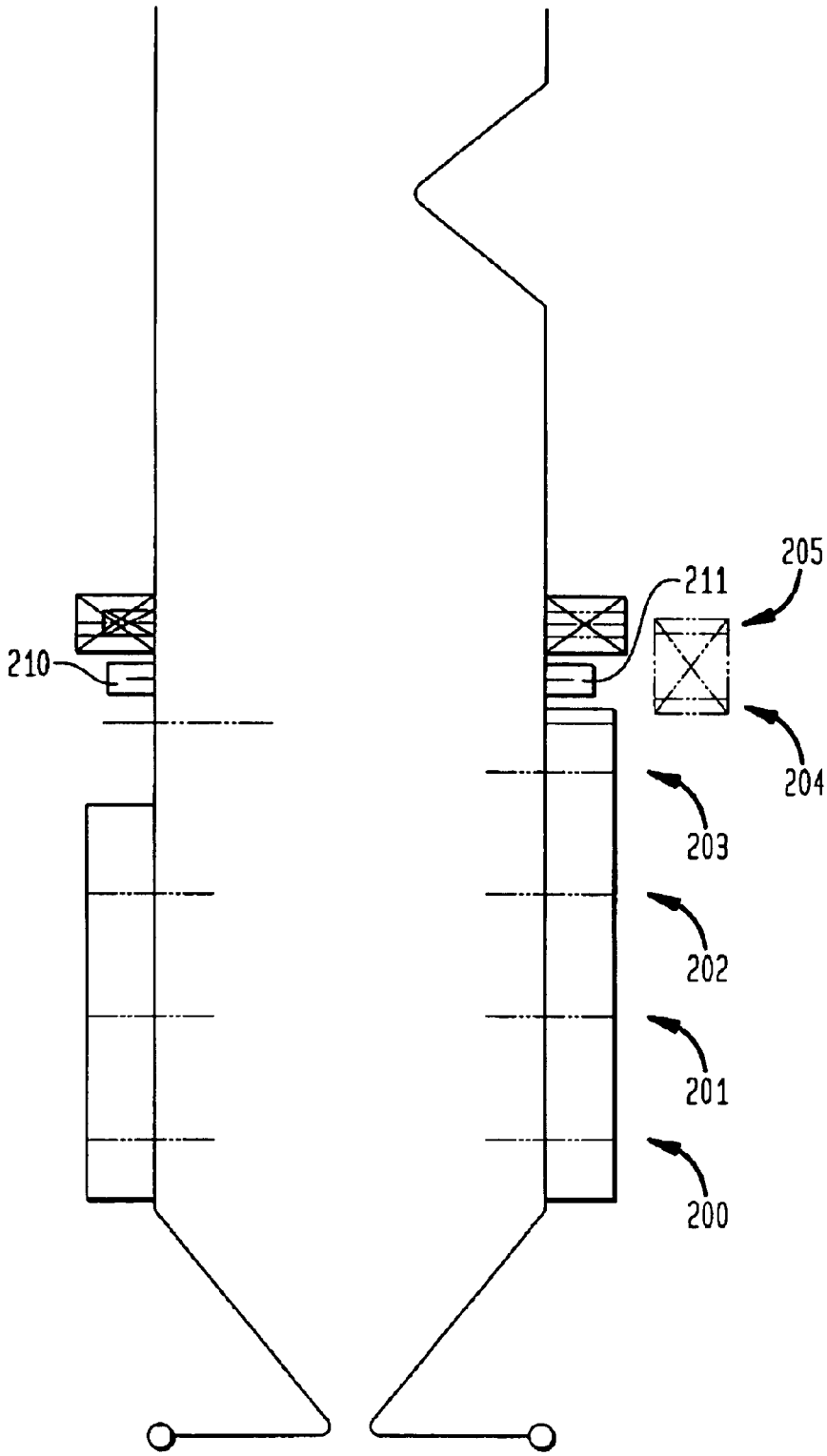
FIG. 9 is a schematic elevational plan view of the OFA port arrangement present furnace system

FIG. 9 is a side elevation view of the furnace system, which incorporates a configuration of OFA ports according to the present invention, as well as an OFA port design according to the present invention. The combustion zone is comprised of burners in rows 200–203. The OFA ports are located in two rows, 204–205, but may include more rows. The OFA ports 210–211 (i.e. the wing ports) located in the vertical lanes (not shown) are seen in lower row 204, closest to the combustion zone.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. An overfire air (OFA) port for use in a furnace, said OFA port comprising:

(a) an inner barrel of said OFA port having inlet and outlet ends, said inner barrel defining an inner passageway extending between said inlet and outlet ends thereof through which air is permitted to flow;

(b) an outer barrel of said OFA port having inlet and outlet ends, said outer barrel surrounding at least a portion of said inner barrel, said outer barrel defining an outer passageway extending between said inlet and outlet ends thereof through which air is permitted to flow; and (c) at least one baffle attached to said outer barrel and arranged between said inner and outer barrels at the proximity of the outlet end to interrupt the flow of air as it exits said outlet end of said outer barrel.

2. The OFA port of claim 1 wherein said baffle is arranged closer to said outlet end of said outer barrel than it is to said inlet end thereof.

3. The OFA port of claim 1, wherein said at least one baffle comprises a plurality of baffles.

4. The OFA port of claim 1 wherein the inlet end of said outer barrel comprises a different geometric configuration than the outlet end of said outer barrel.

5. The OFA port of claim 4 wherein said outlet end of said outer barrel comprises an elliptical configuration.

6. The OFA port of claim 5, wherein the geometrical configuration of said inlet end of said outer barrel comprises a circular configuration.

7. The OFA port of claim 1, wherein the inlet end of said inner barrel comprises a different geometrical configuration than the outlet end of said inner barrel.

8. The OFA port of claim 7, wherein the geometry of said outlet end of said inner barrel comprises an elliptical configuration.

9. The OFA port of claim 7, wherein the geometry of said inlet end of said inner barrel comprises a circular configuration.

10. The OFA port of claim 1, wherein the inlet end of said inner barrel comprises a different geometrical configuration than the outlet end of said inner barrel and said inlet end of said outer barrel comprises a different geometrical configuration than said outlet end of said outer barrel.

11. The OFA port of claim 10, wherein the outlet end of said inner and outer barrels comprise elliptical configurations.

12. An overfire air (OFA) port for use in a furnace, said OFA port comprising:

(a) an inner barrel of said OFA port having inlet and outlet ends, said inner barrel defining an inner passageway extending between said inlet and outlet ends thereof through which air is permitted to flow, said inner barrel further comprising an inner inlet section, an inner transitional section, and a geometric section;

(b) an outer barrel of said OFA port having inlet and outlet ends, said outer barrel surrounding at least a portion of said inner barrel, said outer barrel defining an outer passageway extending between said inlet and outlet ends thereof through which air is permitted to flow, said outer barrel further comprising an outer inlet section and an outer transition section; and (c) at least one baffle attached to said outer barrel and arranged between said inner and outer barrels at the proximity of the outlet end to interrupt the flow of air as it exits said outlet end of said outer barrel.

13. The OFA port of claim 12, wherein said outer transition section of said outer barrel further comprises a transitional inlet and a transitional outlet each having respective dimensions, said dimension of said transitional inlet being smaller than said dimension of said transitional outlet.

14. The OFA port of claim 12, wherein said outer inlet section and said outer transition section are the same length.

15. The OFA port of claim 12, wherein at least two baffles are arranged between said inner and outer barrels to interrupt the flow of air as it exits said outlet end of said outer barrel.

16. The OFA port of claim 12, wherein said inlet end of said outer barrel comprises a different geometrical configuration than the outlet end of said outer barrel.

17. The OFA port of claim 12, wherein said outlet end of said outer barrel comprises an elliptical configuration.

18. The OFA port of claim 12, wherein said inlet end of said inner barrel comprises a circular configuration.

19. A furnace comprising:

(a) at least one burner defining a combustion zone;

(b) at least one overfire air (OFA) port including:

(i) an inner barrel of said OFA port having inlet and outlet ends, said inner barrel defining an inner passageway extending between said inlet and outlet ends thereof through which air is permitted to flow;

(ii) an outer barrel of said OFA port having inlet and outlet ends, said outer barrel surrounding at least a portion of said inner barrel, said outer barrel defining an outer passageway extending between said inlet and outlet ends thereof through which air is permitted to flow; and (iii) at least one baffle attached to said outer barrel and arranged between said inner and outer barrels at the proximity of the outlet end to interrupt the flow of air as it exits said outlet end of said outlet end of said outer barrel.

20. The furnace of claim 19 further comprising a sleeve damper located at said inlet end of said outer barrel to regulate the amount of OFA flowing into said at least one OFA port.

21. An overfire air (OFA) port for use in a furnace, said OFA port comprising:

(a) an inner barrel of said OFA port having inlet and outlet ends, said inner barrel defining an inner passageway extending between said inlet and outlet ends thereof through which air is permitted to flow;

(b) an outer barrel of said OFA port having inlet and outlet ends, said outer barrel surrounding at least a portion of said inner barrel, said outer barrel defining an outer passageway extending between said inlet and outlet ends thereof through which air is permitted to flow, wherein the inlet end of said inner barrel comprises a different geometrical configuration than the outlet end of said inner barrel, and said inlet end of said outer barrel comprises a different geometrical configuration than said outlet end of said outer barrel, wherein the outlet end of said inner and outer barrels comprise an elliptical configuration; and (c) at least one baffle arranged between said inner and outer barrels to interrupt the flow of air as it exits said outlet end of said outer barrel.

* * * * *